US009433043B1

(12) United States Patent
Hanz

(10) Patent No.: US 9,433,043 B1
(45) Date of Patent: Aug. 30, 2016

(54) POWER SUPPLY FOR A PLURALITY OF LIGHT EMITTING DIODES

(71) Applicant: OPTOLUM, INC., Tempe, AZ (US)

(72) Inventor: Douglas Laurence Hanz, Scottsdale, AZ (US)

(73) Assignee: OPTOLUM, INC., Tempe, AZ (US)

( * ) Notice: Subject to any disclaimer, the term of this patent is extended or adjusted under 35 U.S.C. 154(b) by 10 days.

(21) Appl. No.: 14/696,456

(22) Filed: Apr. 26, 2015

(51) Int. Cl.

| | |
|---|---|
| ***H05B 41/16*** | (2006.01) |
| ***H05B 41/24*** | (2006.01) |
| ***H05B 33/08*** | (2006.01) |
| ***H01F 27/24*** | (2006.01) |
| ***H01F 27/28*** | (2006.01) |

(52) U.S. Cl.
CPC ..... *H05B 33/0809* (2013.01); *H01F 27/24* (2013.01); *H01F 27/2804* (2013.01); *H01F 2027/2809* (2013.01)

(58) Field of Classification Search
None
See application file for complete search history.

(56) References Cited

U.S. PATENT DOCUMENTS

| | | | | |
|---|---|---|---|---|
| 6,097,158 A * | 8/2000 | Manor | H02M 7/217 307/66 |
| 8,310,327 B2 * | 11/2012 | Willers | H01F 27/06 336/200 |
| 2004/0032313 A1 * | 2/2004 | Ferencz | H01F 27/266 336/200 |
| 2008/0084167 A1 * | 4/2008 | Waffenschmidt | H02M 3/337 315/210 |

* cited by examiner

*Primary Examiner* — Anh Tran
(74) *Attorney, Agent, or Firm* — Donald J Lenkszus

(57) ABSTRACT

A light emitting diode (LED) power supply providing current to a plurality of LEDs comprises a planar transformer. The planar transformer comprises a first multilayer printed circuit board comprising a first plurality of planar windings electrically connected in series to form a first primary portion. Each winding of the first plurality of planar windings is carried on a separate layer of the first multilayer printed circuit board. The transformer further comprises a second multilayer printed circuit board comprising a second plurality of planar windings electrically connected in series to form a second primary portion. Each winding of the second plurality of planar windings is carried on a separate layer of the second multilayer printed circuit board. The transformer additionally comprises a third multilayer printed circuit board comprising a third planar winding carried on two layers to provide a secondary.

53 Claims, 6 Drawing Sheets

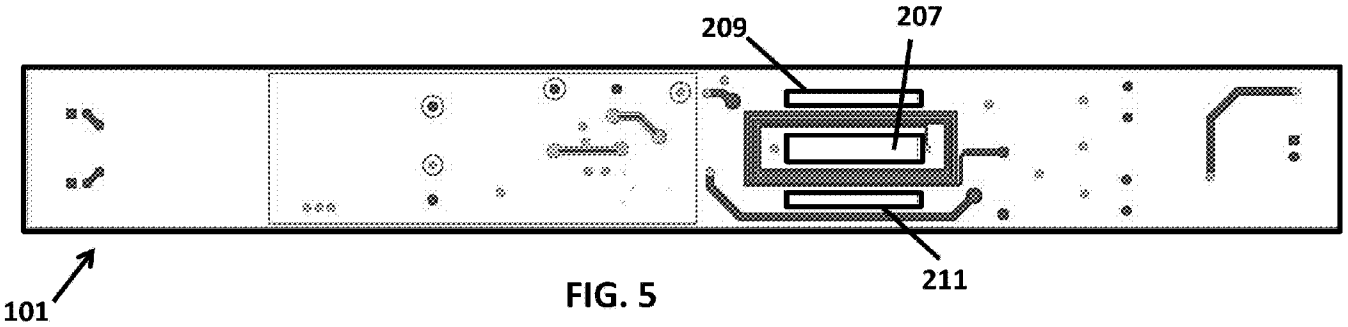
FIG. 5
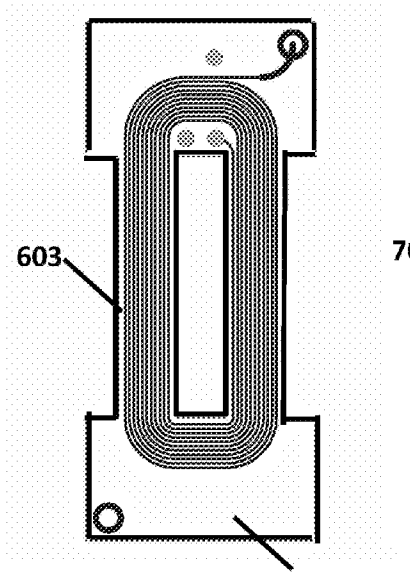
FIG. 6
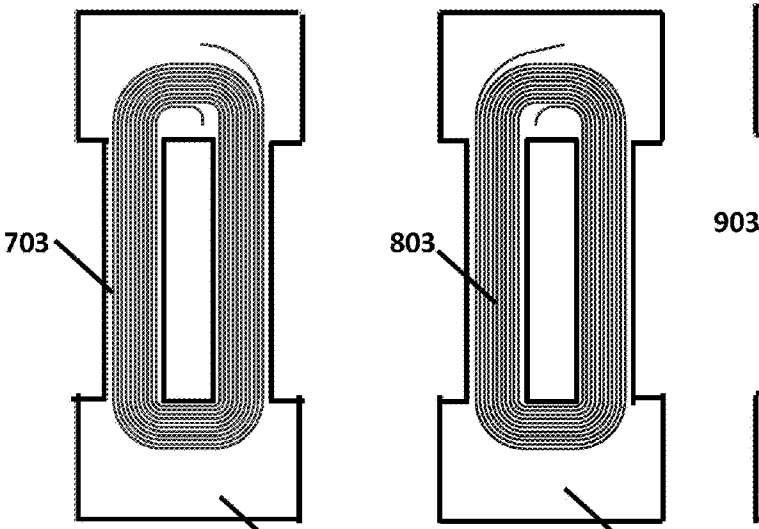
FIG. 7
FIG. 8
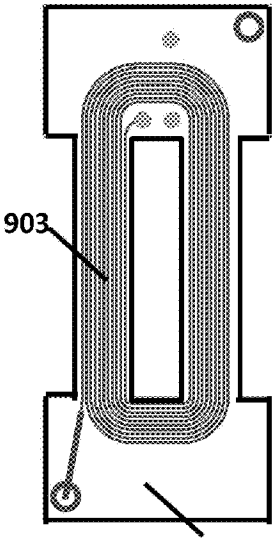
FIG. 9

POWER SUPPLY FOR A PLURALITY OF LIGHT EMITTING DIODES

FIELD OF THE INVENTION

This invention pertains to power supplies, in general, and to power supplies for providing current to a plurality of light emitting diodes, in particular.

BACKGROUND

It is highly desirable to provide a power supply for light emitting diode systems that can provide high power in a thin, compact package.

SUMMARY

An embodiment of a light emitting diode (LED) power supply for providing current to a plurality of LEDs is provided. The embodiment comprises a planar transformer. The planar transformer comprises a first multilayer printed circuit board comprising a first plurality of planar windings electrically connected in series to form a first primary portion. Each winding of the first plurality of planar windings is carried on a separate layer of the first multilayer printed circuit board. The transformer further comprises a second multilayer printed circuit board comprising a second plurality of planar windings electrically connected in series to form a second primary portion. Each winding of the second plurality of planar windings is carried on a separate layer of the second multilayer printed circuit board. The transformer additionally comprises a third multilayer printed circuit board comprising a third planar winding carried on one layer to provide a secondary. The third multilayer printed circuit board comprises a first aperture on one side of the third planar winding, a second aperture on an opposite side of the third planar winding, and a central aperture surrounded by the third planar winding. The third multilayer printed circuit board comprises a top surface carrying the first multilayer printed circuit board and a bottom surface carrying the second multilayer printed circuit board. The first and second multilayer printed circuit boards are disposed such that the first primary portion, the second primary portion and the secondary are in vertical alignment with each other to maximize electromagnetic coupling.

The transformer further comprises a first core consisting of a ferrite material and comprising first and second outer legs and a middle leg. The first core is carried on the first multilayer printed circuit board such that the middle leg extends therethrough in the middle of the first plurality of planar windings, and the first and second outer legs extend therethrough on opposite sides of the first plurality of planar windings. The transformer also comprises a second core consisting of the ferrite material and comprising first and second outer legs and a middle leg. The second core is carried on the second multilayer printed circuit board such that the middle leg extends therethrough in the middle of the second plurality of planar windings, and the first and second outer legs extend therethrough on opposite sides of the second plurality of planar windings.

The first and the second outer legs of the first core extend into the third multilayer printed circuit board. The first and the second outer legs of the second core extending into the third multilayer printed circuit board and in physical engagement with the first and the second outer legs of the first core, respectively. The middle leg of the first core and the middle leg of the second core are disposed proximate to each other in alignment with the central aperture such that a predetermined air gap is provided there between.

The embodiment further comprises a first rectifier circuit carried on the third multilayer printed circuit board for rectifying alternating current (ac) from a power source; a driver circuit carried on the third multilayer printed circuit board and disposed between the first rectifier circuit and the first and second primary portions; and a second rectifier circuit carried on the third multilayer printed circuit board and coupled to the secondary and coupled to output power terminals to provide direct current for powering the plurality of LEDs.

In accordance with one aspect of the embodiment, the third multilayer printed circuit board comprises a fourth planar winding carried on another layer to provide a bias winding, and the bias winding is coupled to the driver circuit.

In accordance with another aspect of the embodiment a plurality of terminals is carried by the third multilayer printed circuit board. The first primary portion is connected to first terminals of the plurality of terminals, the second primary portion is connected to second terminals of the plurality of terminals, and the first terminals and the second terminals are selectively connectable to connect the first primary portion in parallel with or in series with the second primary portion.

The embodiment may further comprise a first filter circuit disposed between the first rectifier circuit and the driver.

The embodiment may also further comprise a second filter circuit disposed between the second rectifier circuit and the output power terminals.

The embodiment may comprise a first insulating layer disposed between the first multilayer printed circuit board and the first core, a second insulating layer disposed between the first multilayer printed circuit board and the third multilayer printed circuit board, a third insulating layer disposed between the second multilayer printed circuit board and the second core, and a fourth insulating layer disposed between the second multilayer printed circuit board and the third multilayer printed circuit board.

Each of the first, second, third and fourth insulating layers may comprise polyimide.

A second embodiment of light emitting diode (LED) power supply for providing current to a plurality of LEDs comprises a transformer first primary portion comprising a plurality of serially connected planar first primary windings, a transformer second primary portion comprising a plurality of serially connected planar second primary windings, and a transformer secondary comprising a planar secondary winding. The second embodiment further comprises a multilayer printed circuit board comprising at least one layer having the planar secondary winding formed thereon. The second embodiment comprises a first multilayer printed circuit board carried on the multilayer printed circuit board. Each of the planar first primary windings is carried on a corresponding separate one layer of the first multilayer printed circuit boards. The second embodiment comprises a second multilayer printed circuit board carried on the multilayer printed circuit board. Each of the planar second primary windings is carried on a corresponding separate one layer of the second multilayer printed circuit board. The transformer first portion, the transformer second portion and the secondary are in axial alignment with each other to provide electromagnetic coupling there between. A transformer core is carried by the multilayer printed circuit board extending over the first primary portion and the second primary portion and extending through the multilayer printed circuit board.

The second embodiment comprises a first rectifier circuit carried on the multilayer printed circuit board for rectifying alternating current (ac) from a power source, a driver circuit carried on the multilayer printed circuit board and disposed between the first rectifier circuit and the first and second primary portions, and a second rectifier circuit carried on the multilayer printed circuit board and coupled to the secondary and coupled to output power terminals to provide direct current for powering the plurality of LEDs.

The multilayer printed circuit board comprises a fourth planar winding carried on another layer to provide a bias winding. The bias winding is coupled to the driver circuit.

The second embodiment may comprise a plurality of terminals carried by the multilayer printed circuit board. The first primary portion is connected to first terminals of the plurality of terminals. The second primary portion is connected to second terminals of the plurality of terminals. The first terminals and the second terminals are selectively connectable to connect the first primary portion in parallel with or in series with the second primary portion.

The second embodiment may comprise a first filter circuit disposed between the first rectifier circuit and the driver.

The second embodiment may further comprise a second filter circuit disposed between the second rectifier circuit and the output power terminals.

The second embodiment may comprise a first insulating layer disposed between the first multilayer printed circuit board and the first core, a second insulating layer disposed between the first multilayer printed circuit board and the multilayer printed circuit board, a third insulating layer disposed between the second multilayer printed circuit board and the second core, and a fourth insulating layer disposed between the second multilayer printed circuit board and the multilayer printed circuit board.

Each of the first, second, third and fourth insulating layers may comprise polyimide.

A third embodiment of a light emitting diode (LED) power supply for providing current to a plurality of LEDs, comprises a transformer first primary portion, a transformer second primary portion, a transformer secondary portion, and a multilayer printed circuit board. The multilayer printed circuit board comprises at least one layer having a planar secondary winding formed thereon, the transformer secondary portion comprising the planar secondary winding. The multilayer printed circuit board further comprises a plurality of first multilayer printed circuit boards carried on the multilayer printed circuit board. The transformer first primary portion comprises a plurality of serially connected planar first primary windings. Each of the planar first primary windings is carried on a corresponding separate one layer of the plurality of first multilayer printed circuit boards. The transformer second primary portion comprises a plurality of serially connected planar second primary windings. Each of the planar second primary windings is carried on a corresponding separate one layer of the plurality of second multilayer printed circuit boards.

The plurality of first multilayer printed circuit boards, the plurality of second multilayer printed circuit boards, and the planar secondary winding are in alignment with each other to provide electromagnetic coupling there between.

A transformer core is carried by the multilayer printed circuit board extends over the first primary portion and the second primary portion and extends through the multilayer printed circuit board.

BRIEF DESCRIPTION OF THE DRAWING

The invention will be better understood from a reading of the following detailed description of preferred embodiments of the invention in which like reference designators identify like elements:

FIG. 5 illustrates a fourth layer of the multilayer printed circuit board of FIG. 2;

FIGS. 6 through 9 illustrates layers of a second multilayer printed circuit;

DETAILED DESCRIPTION

Figure 1:
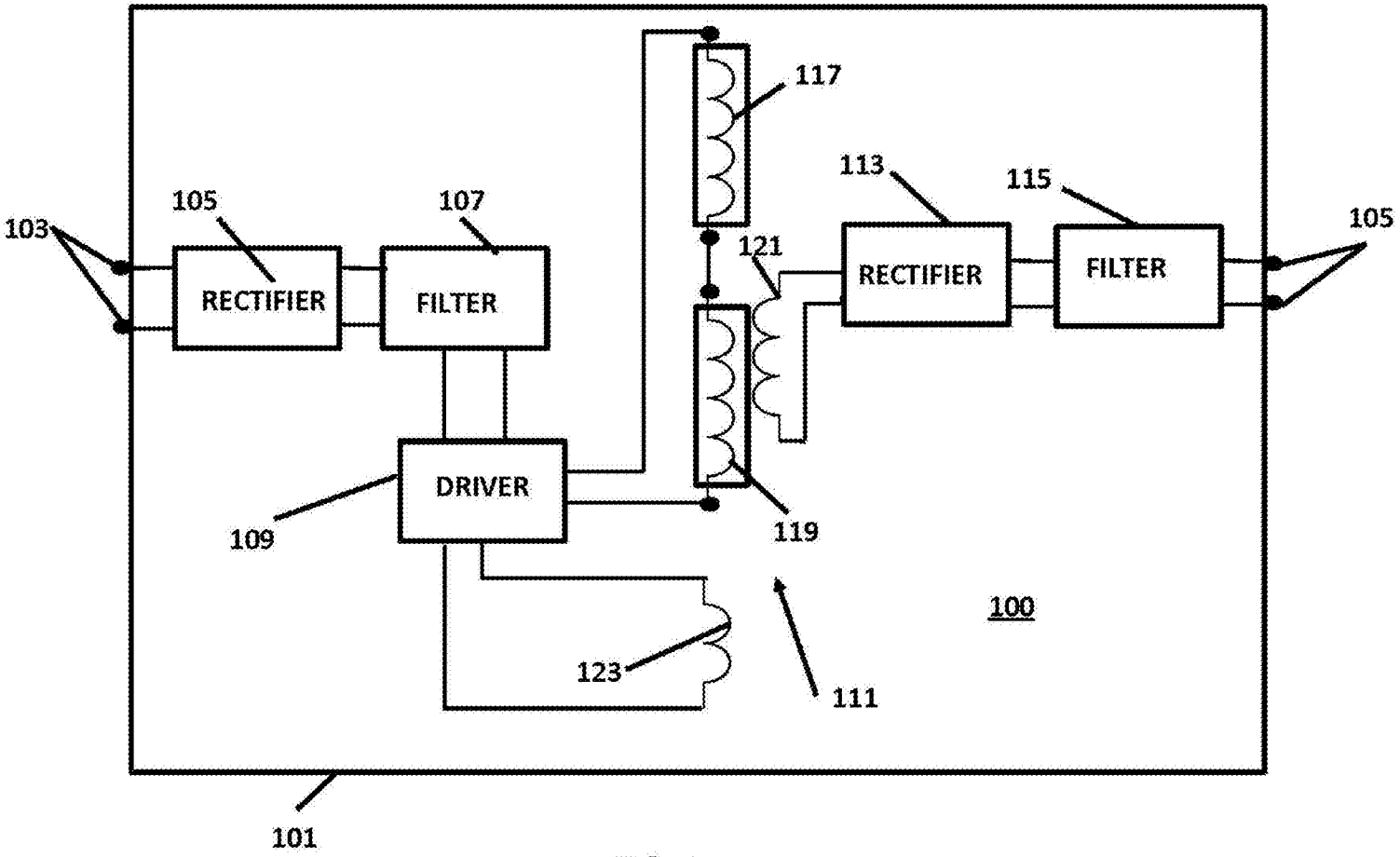
FIG. 1 is a block diagram of an embodiment of the invention.

Turning now to FIG. 1 a power supply 100 for powering a plurality of LEDs from an alternating current (ac) power source is shown. Power supply 100 comprises multilayer printed circuit board 101. Contact pads 103 are carried on a top surface of multilayer printed circuit board 101. Contact pads 103 are connectable to an ac power line. A rectifier circuit 105 is coupled to contact pads 103. In the embodiment, rectifier circuit 105 is a commercially available bridge rectifier module. Direct current (dc) outputs from rectifier circuit 105 are filtered by filter circuit 107 to provide a filtered dc output. The filtered dc output from filter circuit 107 is provided to driver circuit 109. Driver circuit 109 comprises a commercially available integrated circuit such as a "non-isolated, phase dimmable, buck power factor controller LED driver" TPS92075 available from Texas Instruments. Driver circuit 109 is connected to the primary of a planar transformer 111. The primary of this embodiment comprises a first portion 117 and a second portion 119. In the embodiment shown, primary first portion 117 is connected in series with primary second portion 119. Transformer 111 further comprises a bias winding 123 connected to driver circuit 109. Transformer 111 comprises a secondary winding 121 that is connected to a second rectifier circuit 113. Second rectifier circuit 113 is a commercially available circuit and its dc output is connected to a second filter circuit 115 that provides filtered dc current for LEDs at terminals 105.

Primary first portion 117 is connected to terminals 117*a*, 117*b*. Primary second portion 119 is connected to terminals 119*a*, 119*b*. In the embodiment shown in FIGS. 1 terminals 117*b* and 119*a* are connected so that primary first portion 117 is connected in series with primary second portion 119. This connection arrangement is utilized when the ac source to be connected to terminals 103 is 220-277 volts. Primary first portion 117 and primary second portion 119 are connected in parallel when the ac source at terminals 103 is 100-130 volts.

Advantageously, the entirety of power supply 100 is on a single multilayer circuit board 101. Still further, power supply 100 carries transformer 111 with secondary winding 121 and bias winding 123 integrated into multilayer circuit board 101 and primary first portion 117 and primary second portion 119 formed as planar transformer windings on first and second multilayer printed circuit boards carried on multilayer printed circuit board 101.

Figure 2:
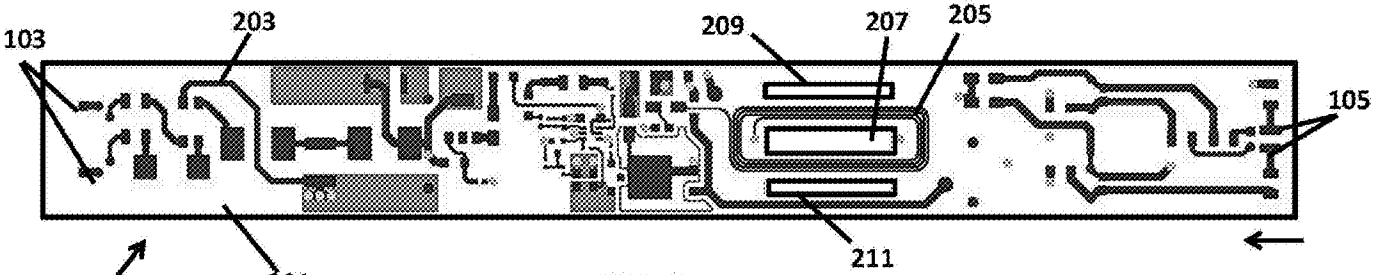
FIG. 2 illustrates a top layer of a multilayer printed circuit board.
Figure 3:
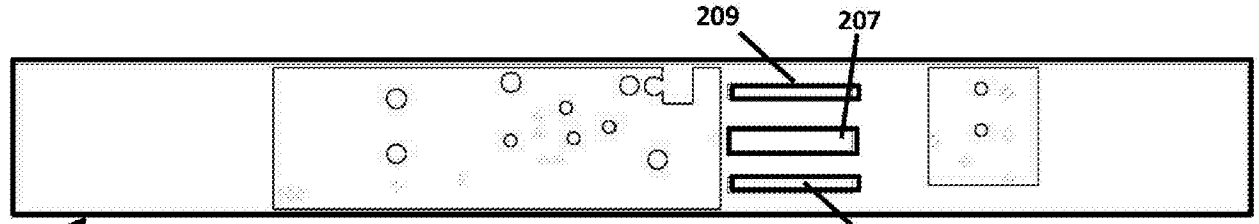
FIG. 3 illustrates a second layer of the multilayer printed circuit board of FIG. 2.
Figure 4:
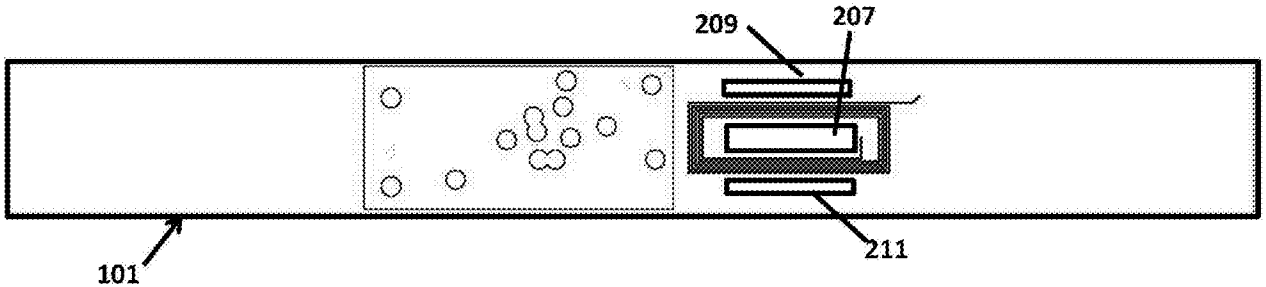
FIG. 4 illustrates a third layer of the multilayer printed circuit board of FIG. 2.

Turning now to FIGS. 2 through 5, several different layers 201, 301, 401, 501 of multilayer printed circuit board 101 are shown. It will be apparent to those skilled in the art that although four layers are shown in the drawing figures that there may be more or less than four layers in other embodiments. FIG. 2 shows a top layer 201 of multilayer printed circuit board 101. Top layer 201 carries printed conductive traces 203 only one of which is identified for clarity. Top layer 201 also carries ac input contacts 103 for connection to an ac line voltage source and dc output contacts 105 for connection to LEDs. Top layer 201 additionally carries a planar bias winding 205. It should also be apparent to those skilled in the art that planar bias winding 205 may be carried on another layer rather than the top layer 201. Planar bias winding 205 comprises a conductive trace formed onto layer 201.

In each of the layers 201, 203, 204, 205 are three elongate apertures 207, 209, 211 that are disposed such that the two outer apertures 209, 211 are disposed on opposite sides of central aperture 207. Central aperture 207 is positioned to be centered in one end portion of multilayer circuit board 101 such that bias winding 205 is centered around central aperture 207 and contained within outer apertures 209, 211.

Layer 401 carries a planar secondary winding portion 405 that is also positioned to be centered around central aperture 207 and contained within outer apertures 209, 211. Similarly layer 501 carries a planar secondary winding portion 505 that is positioned to be centered around central aperture 207. Planar secondary winding portions 405, 505 each comprise conductive traces formed on the respective layers 401, 501. It will be apparent to those skilled in the art that although two secondary winding portions 401, 501 are shown in the embodiment, other embodiments may comprise only one winding portion or more than two winding portions on different layers. The two secondary winding portions may be connected in series or in parallel utilizing through vias in multilayer printed circuit board 101.

Figure 10:
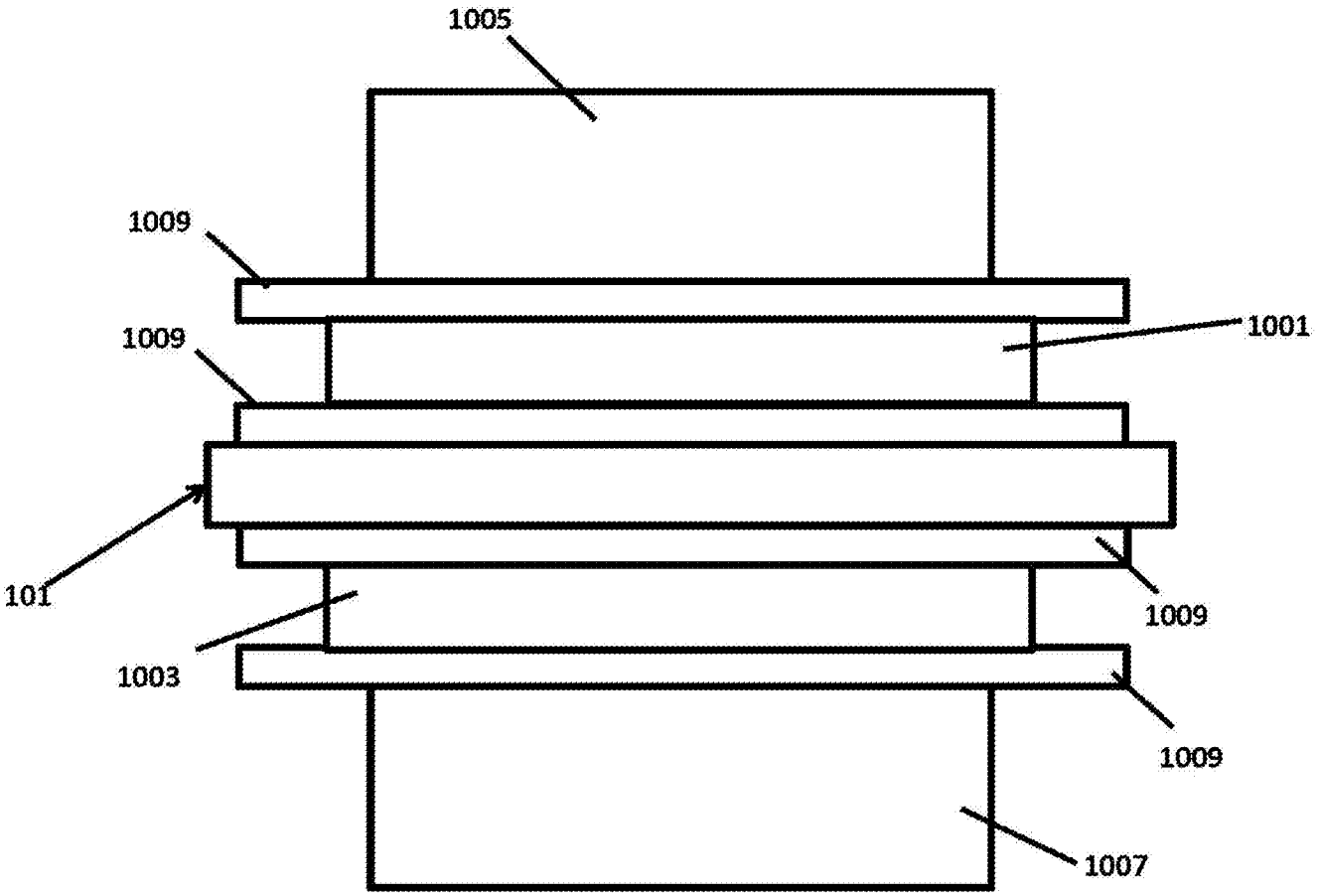
FIG. 10 is a side view of a planar transformer portion of an assembled LED power supply.

Two primary winding portions 117, 119 are carried on top and bottom surfaces 101*a*, 101*b* of multilayer printed circuit board 101 as shown in FIG. 10.

Primary winding portions 117, 119 are identical and comprise a plurality of layers of corresponding multilayer printed circuit boards 1001, 1003, respectively.

FIGS. 6-9 show layers 601, 701, 801, 901 of multilayer printed circuit board 1001. Layer 601 is a top layer and includes spiral conductive trace 603 forming one section of a planar primary winding. One end 607 of spiral conductive trace 603 is connected to through terminal via 601*a* and the other end 605 of spiral conductive trace 603 is connected to a through via 601*b*. Layer 701 is an intermediate layer and includes spiral conductive trace 703 forming one section of a planar primary winding. One end 705 of spiral conductive trace 703 is connected with end 605 of spiral trace 603 through via 605. The other end 707 of spiral conductive trace 703 is connected to a through via that is not shown. Layer 801 is an intermediate layer and includes spiral conductive trace 803 forming one section of a planar primary winding. One end 807 of spiral conductive trace 803 is connected with end 707 of spiral trace 703 by a through via that is not shown. Layer 901 is a bottom layer and includes spiral conductive trace 903 forming one section of a planar primary winding. One end 905 of spiral conductive trace 903 is connected to end 805 of spiral conductive trace 803 by a through via 905. The other end 907 or spiral conductive trace 903 is connected to terminal 901*a*. Spiral conductive traces 603, 703, 803, 903 are connected in series to form a planar first primary portion 117. Planar second primary portion 119 is constructed in the same manner.

It will be appreciated by those skilled in the art that each of planar first primary portion 117 and planar second primary portion 119 may comprise more or less layers of a multilayer printed circuit board. The number of layers and the number of turns of the spiral trace on each layer is determined in accordance with well-known transformer design principles and algorithms.

Figure 11:
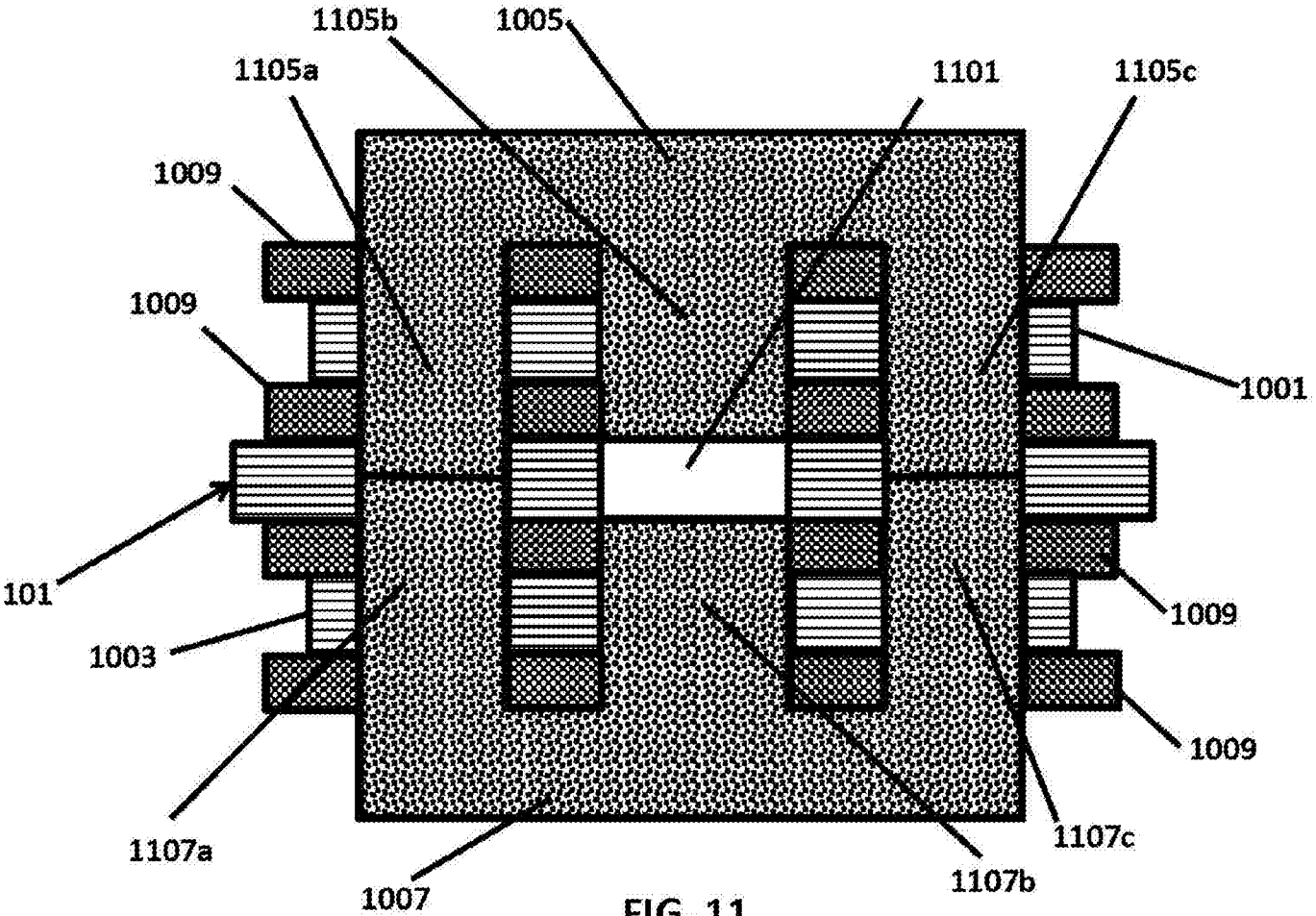
FIG. 11 is a cross-section of the planar transformer portion of FIG. 11.

Planar transformer 111 is shown in end view in FIG. 10 and in cross-section view in FIG. 11. Planar transformer 111 comprises multilayer printed circuit board 101 that in turn comprises planar bias winding 123 that in turn comprises spiral trace 205 formed on layer 201. Multilayer printed circuit board 101 further comprises and planar secondary winding 121 that in turn comprises spiral traces 405, 505 formed on layers 401, 401.

Planar transformer 111 further comprises first multilayer printed circuit board 1001*a* comprising layers 601, 701, 801, 901 carried above top surface 101*a* of multilayer printed circuit board 101 and a second multilayer printed circuit board 1001*b* comprising layers 601, 701, 801, 901 is carried below bottom surface 101*b* of multilayer printed circuit board 101. Insulating layers 1009 are provided between multilayer printed circuit board 101 and each of first and second multilayer printed circuit boards. In addition, insulating layers are also provided to cover first and second multilayer printed board outer surfaces 1009*a*, 1009*b*.

Figure 12:
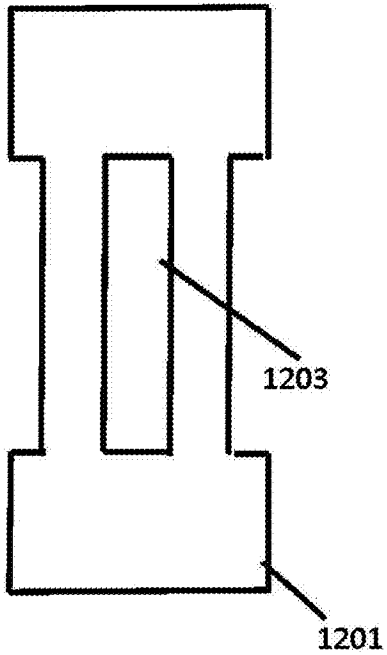
FIG. 12 illustrates an insulating layer.

Each insulating layer 1009 comprises a polyimide material and is shaped as shown in FIG. 12. Each insulating layer 1009 includes a central aperture 1207 that is disposed to be in alignment with central aperture 207 of multilayer printed circuit board 101 and first and second multilayer printed circuit boards 1001*a*, 1001*b*. Each insulating layer 1009 also comprises a pair of side channels 1209, 1211 that are disposed to be in alignment with apertures 209, 211 of multilayer printed circuit board 101 and first and second multilayer printed circuit boards 1001*a*, 1001*b* when planar transformer 111 is assembled.

Figure 13:
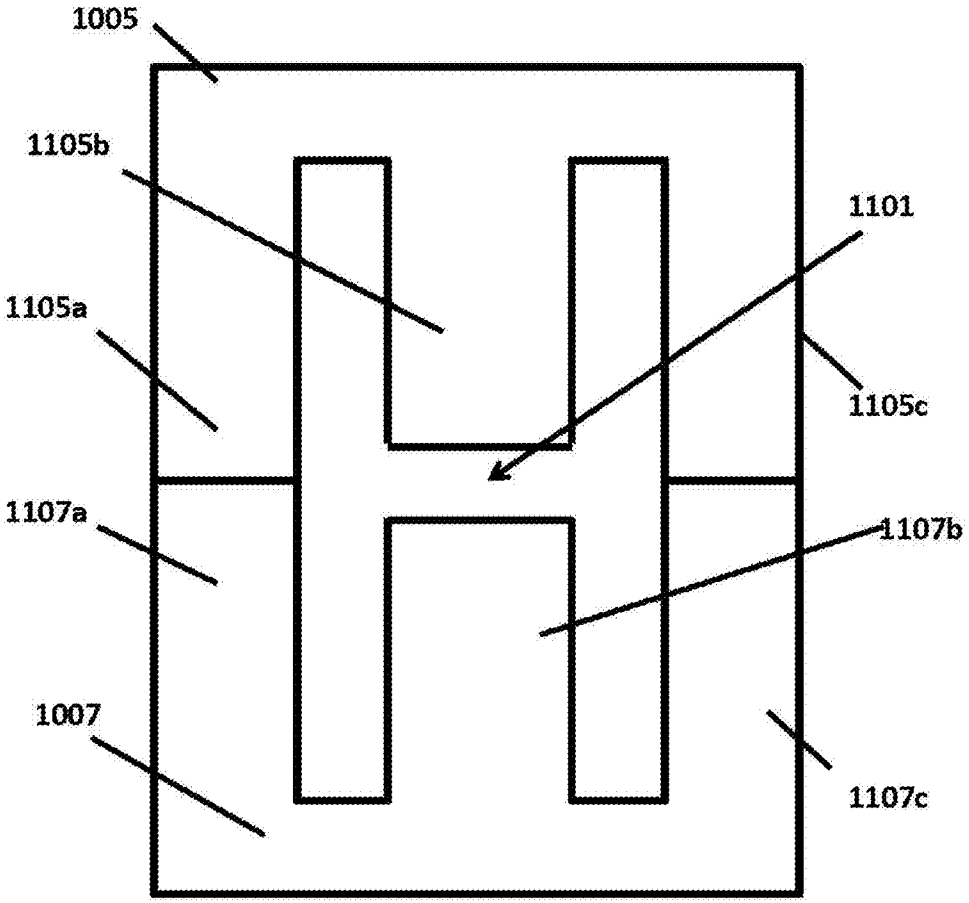
FIG. 13 illustrates two ferromagnetic cores.

Planar transformer 111 comprises two transformer cores 1005, 1007 each having an E-shaped cross section as most clearly seen in FIG. 13. Transformer cores 1005, 1007 each comprise a ferrite material and are commercially available. Transformer core 1005 comprises outer legs 1105*a*, 1105*c* and middle or center leg 1105*b*. Transformer core 1007 comprises outer legs 1107*a*, 1107*c* and middle or center leg 1107*b*. Outer legs 1105*a*, 1105*c* engage outer legs 1107*a*, 1107*c*, respectively, when transformer cores 1005, 1007 are assembled into apertures 209, 211. Center legs 1105*b*, 1107*b* have a length such that a predetermined air gap 1101 is provided there between. It will be apparent to those skilled in the art that although cores of E-shaped cross section are utilized in this embodiment, other embodiments may use other core shapes such as, by way of non-limiting example, rectangular modulus (RM) shaped cores.

The embodiment of a light emitting diode (LED) power supply 100 for providing current to a plurality of LEDs shown in the drawing figures comprises a planar transformer 111. Planar transformer 111 comprises a first multilayer printed circuit board 1001*a* comprising a first plurality of planar windings 603, 703, 803, 903 electrically connected in series to form a first primary portion 117. Each planar winding 603, 703, 803, 903 of the first plurality of planar windings is carried on a separate layer 601, 701, 801, 901 of the first multilayer printed circuit board 1001. Transformer 111 further comprises a second multilayer printed circuit board 1003 comprising a second plurality of planar windings 603, 703, 803, 903 electrically connected in series to form a second primary portion 119. Each winding 603, 703, 803, 903 of the second plurality of planar windings is carried on a separate layer 601, 701, 801, 901 of the second multilayer printed circuit board 1003. Transformer 111 additionally comprises a third multilayer printed circuit board 101 comprising a third planar winding 405 carried on one layer 401 to provide a secondary 121. Third multilayer printed circuit board 101 comprises a first aperture 209 on one side of third planar winding 405, a second aperture 211 on an opposite side of the third planar winding 405, and a central aperture 207 surrounded by third planar winding 405. Third multilayer printed circuit board 101 comprises a top surface 101*a* carrying first multilayer printed circuit board 1001*a* and a bottom surface 101*b* carrying second multilayer printed circuit board 1001*b*. First and second multilayer printed circuit boards 1001*a*, 1001*b* are disposed such that first primary portion 117, second primary portion 119 and secondary 121 are in vertical alignment with each other to maximize electromagnetic transformer coupling.

Transformer 111 further comprises a first core 1005 of E-shaped cross-section consisting of a ferrite material and comprising first and second outer legs 1105*a*, 1105*c* and a middle leg 1105*b*. First core 1005 is carried on first multilayer printed circuit board 1001*a* such that the middle leg 1105*b* extends therethrough in the middle of the first plurality of planar windings 603, 703, 803, 903, and the first and second outer legs 1105*a*, 1105*c* extend therethrough on opposite sides of the first plurality of planar windings 603, 703, 803, 903. Transformer 111 also comprises a second core 1007 of E-shaped cross-section consisting of the ferrite material and comprising first and second outer legs 1107*a*, 1107*c* and a middle leg 1107*b*. Second core 1107 is carried on second multilayer printed circuit board 1003 such that middle leg 1107*b* extends therethrough in the middle of the second plurality of planar windings 603, 703, 803, 903, and the first and second outer legs 1107*a*, 1107*c* extend therethrough on opposite sides of the second plurality of planar windings 603, 703, 803, 903.

First and the second outer legs 1105*a*, 1105*c* of first core 1005 extend into the third multilayer printed circuit board 101. First and the second outer legs 1107*a*, 1107*c* of second core 1007 extend into third multilayer printed circuit board 101 and are in physical engagement with the first and the second outer legs 1105*a*, 1105*c* of first core 1005, respectively. Middle leg 1105*b* of first core 1005 and middle leg 1107*b* of second core 1007 are disposed proximate to each other in alignment with the central aperture such that a predetermined air gap 1101 is provided there between.

The embodiment further comprises a first rectifier circuit 105 carried on third multilayer printed circuit board 101 for rectifying alternating current (ac) from a power source coupled to terminals 103; a driver circuit 109 carried on third multilayer printed circuit board 101 and disposed between first rectifier circuit 105 and first and second primary portions 117, 119; and a second rectifier circuit 113 carried on third multilayer printed circuit board 101 and coupled to secondary 121 and coupled to output power terminals 105 to provide direct current for powering the plurality of LEDs.

In accordance with one aspect of the embodiment, third multilayer printed circuit board 101 comprises a fourth planar winding 205 carried on another layer 201 to provide a bias winding 123, and bias winding 123 is coupled to driver circuit 109.

In accordance with another aspect of the embodiment, a plurality of terminals 117*a*, 117*b*, 119*a*, 119*b* is carried by third multilayer printed circuit board 101. First primary portion 117 is connected to first terminals 117*a*, 117*b* of the plurality of terminals, second primary portion 119 is connected to second terminals 119*a*, 119*b* of the plurality of terminals. The first terminals 117*a*, 117*b* and second terminals 119*a*, 119*b* are selectively connectable to connect first primary portion 117 in parallel with or in series with second primary portion 119.

The embodiment may further comprise a first filter circuit 107 disposed between first rectifier circuit 105 and driver 109.

The embodiment may also further comprise a second filter circuit 115 disposed between second rectifier circuit 113 and output power terminals 105.

The embodiment may comprise a first insulating layer 1009 disposed between first multilayer printed circuit board 1001 and first core 1005, a second insulating layer 1009 disposed between first multilayer printed circuit board 1001 and third multilayer printed circuit board 101, a third insulating layer 1009 disposed between second multilayer printed circuit board 1003 and second core 1007, and a fourth insulating layer 1009 disposed between second multilayer printed circuit board 1003 and third multilayer printed circuit board 101.

Each of the first, second, third and fourth insulating layers 1009 may comprise polyimide.

A second embodiment of light emitting diode (LED) power supply 100 for providing current to a plurality of LEDs comprises a transformer first primary portion 117 comprising a plurality of serially connected planar first primary windings 603, 703, 803, 903, a transformer second primary portion 121 comprising a plurality of serially connected planar second primary windings 603, 703, 803, 903 and a transformer secondary 121 comprising a planar secondary winding 405. The second embodiment further comprises a multilayer printed circuit board 101 comprising at least one layer 401, 501 having the planar secondary winding 405, 505 formed thereon. The second embodiment comprises a first multilayer printed circuit board 1001 carried on multilayer printed circuit board 101. Each of planar first primary windings 603, 703, 803, 903 is carried on a corresponding separate one layer 601, 701, 801, 901 of the first multilayer printed circuit board 1001. The second embodiment comprises a second multilayer printed circuit board 1003 carried on multilayer printed circuit board 101. Each of planar second primary windings 603, 703, 803, 903 carried on a corresponding separate one layer 601, 701, 801, 901 of multilayer second printed circuit board 1003. First primary portion 117 carried by first multilayer printed circuit board 1001, second primary portion 119 carried by second multilayer printed circuit board 1003, and planar secondary winding 121 are in axial alignment with each other to provide electromagnetic transformer coupling there between. A transformer core 1005, 1007 is carried by multilayer printed circuit board 101 extending over the first primary portion 117 and second primary portion 119 and extends through the multilayer printed circuit board 101.

The second embodiment comprises a first rectifier circuit 105 carried on multilayer printed circuit board 101 for rectifying alternating current (ac) from a power source connected to terminals 103, a driver circuit 109 carried on multilayer printed circuit board 101 and disposed between first rectifier circuit 105 and the first and second primary portions 117, 119 and a second rectifier circuit 113 carried on multilayer printed circuit board 101 and coupled to secondary 123 and coupled to output power terminals 105 to provide direct current for powering the plurality of LEDs.

Multilayer printed circuit board 101 comprises a fourth planar winding 205 carried on another layer to provide a bias winding 123. Bias winding 123 is coupled to driver circuit 109.

The second embodiment may comprise a plurality of terminals 117*a*, 117*b*, 119*a*, 119*b* carried by multilayer printed circuit board 101. First primary portion 117 is connected to first terminals 117*a*, 117*b* of the plurality of terminals. Second primary portion is connected to second terminals 119*a*, 119*b* of the plurality of terminals. First terminals 117*a*, 117*b* and second terminals 119*a*, 119*b* are selectively connectable to connect first primary portion 117 in parallel with or in series with second primary portion 119.

The second embodiment may comprise a first filter circuit 107 disposed between first rectifier circuit 105 and driver 109.

The second embodiment may further comprise a second filter circuit 115 disposed between second rectifier circuit 113 and output power terminals 105.

The second embodiment may comprise a first insulating layer 1009 disposed between first multilayer printed circuit board 1001*a* and a first core portion 1005, a second insulating layer 1009 disposed between first multilayer printed circuit board 1001*a* and multilayer printed circuit board 101, a third insulating layer 1008 disposed between second multilayer printed circuit board 1001*b* and second core portion 1007, and a fourth insulating layer disposed between second multilayer printed circuit board 1001*b* and multilayer printed circuit board 101.

Each of the first, second, third and fourth insulating layers 1009 may comprise polyimide.

A third embodiment of a light emitting diode (LED) power supply 100 for providing current to a plurality of LEDs, comprises a transformer first primary portion 117, a transformer second primary portion 119, a transformer secondary portion 123, and a multilayer printed circuit board 101. Multilayer printed circuit board 101 comprises at least one layer 401, 501 having a planar secondary winding 405, 505 formed thereon. Transformer secondary portion comprises planar secondary winding 405, 505. Multilayer printed circuit board 101 further comprises a plurality of first multilayer printed circuit boards 1001*a* carried on multilayer printed circuit board 101. Transformer first primary portion 117 comprises a plurality of serially connected planar first primary windings 603, 703, 803, 903. Each of planar first primary windings 603, 703, 803, 903 is carried on a corresponding separate one layer 601, 701, 801, 901 of the plurality of first multilayer printed circuit boards 1001*a*. Transformer second primary portion 119 also comprises a plurality of serially connected planar first primary windings 603, 703, 803, 903. Each of planar first primary windings 603, 703, 803, 903 is carried on a corresponding separate one layer 601, 701, 801, 901 of the plurality of second multilayer printed circuit boards 1001*a*.

The plurality of first multilayer printed circuit boards, the plurality of second multilayer printed circuit boards, and the planar secondary winding are in alignment with each other to provide electromagnetic coupling there between.

It will be understood by those skilled in the art that the dimensions shown in the various drawing figures are not intended to in any way limit the invention and that the various sizes and shapes of the various elements are intended only to be representative of those elements and are likewise not intended to limit the invention.

The invention has been described in conjunction with various embodiments. It will be understood by those skilled in the art that the invention is not limited by the various embodiments shown and described herein. Various modifications may be made without departing from the scope of the invention. It is intended that the invention shall be limited in scope only by the claims appended hereto.

What is claimed is:

1. A light emitting diode (LED) power supply for providing current to a plurality of LEDs, comprising:

a transformer comprising:

a first multilayer printed circuit board comprising a first plurality of planar windings electrically connected in series to form a first primary portion, each winding of said first plurality of planar windings being carried on a separate layer of said first multilayer printed circuit board;

a second multilayer printed circuit board comprising a second plurality of planar windings electrically connected in series to form a second primary portion, each winding of said second plurality of planar windings being carried on a separate layer of said second multilayer printed circuit board;

a third multilayer printed circuit board comprising a third planar winding carried on one layer to provide a secondary;

said third multilayer printed circuit board comprising a first aperture on one side of said third planar winding, a second aperture on an opposite side of said third planar winding, and a central aperture surrounded by said third planar winding;

said third multilayer printed circuit board comprising a top surface carrying said first multilayer printed circuit board and a bottom surface carrying said second multilayer printed circuit board, said first and second multilayer printed circuit boards being disposed such that said first primary portion, said second primary portion and said secondary are in vertical alignment with each other to maximize electromagnetic coupling;

a first core consisting of a ferrite material and comprising first and second outer legs and a middle leg, said first core being carried on said first multilayer printed circuit board such that said middle leg extends therethrough in the middle of said first plurality of planar windings, and said first and second outer legs extend therethrough on opposite sides of said first plurality of planar windings;

a second core consisting of said ferrite material and comprising first and second outer legs and a middle leg, said second core being carried on said second multilayer printed circuit board such that said middle leg extends therethrough in the middle of said second plurality of planar windings, and said first and second outer legs extend therethrough on opposite sides of said second plurality of planar windings;

said first and said second outer legs of said first core extend into said third multilayer printed circuit board;

said first and said second outer legs of said second core extend into said third multilayer printed circuit board and in physical engagement with said first and said second outer legs of said first core, respectively;

said middle leg of said first core and said middle leg of said second core are disposed proximate to each other in alignment with said central aperture such that a predetermined air gap is provided there between;

a first rectifier circuit carried on said third multilayer printed circuit board for rectifying alternating current (ac) from a power source;

a driver circuit carried on said third multilayer printed circuit board and disposed between said first rectifier circuit and said first and second primary portions; and a second rectifier circuit carried on said third multilayer printed circuit board and coupled to said secondary and coupled to output power terminals to provide direct current for powering said plurality of LEDs.

2. A LED power supply in accordance with claim 1, wherein:

said third multilayer printed circuit board comprises a fourth planar winding carried on another layer to provide a bias winding; and said bias winding is coupled to said driver circuit.

3. A LED power supply in accordance with claim 2, comprising:

a plurality of terminals carried by said third multilayer printed circuit board;

said first primary portion connected to first terminals of said plurality of terminals;

said second primary portion connected to second terminals of said plurality of terminals; and said first terminals and said second terminals being selectively connectable to connect said first primary portion in parallel with or in series with said second primary portion.

4. A LED power supply in accordance with claim 3, comprising:

a first filter circuit disposed between said first rectifier circuit and said driver.

5. A LED power supply in accordance with claim 4, comprising:

a second filter circuit disposed between said second rectifier circuit and said output power terminals.

6. A LED power supply in accordance with claim 1, comprising:

a plurality of terminals carried by said third multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

7. A LED power supply in accordance with claim 6, comprising:

a plurality of terminals carried by said third multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

8. A LED power supply in accordance with claim 7, comprising:

a first filter circuit disposed between said first rectifier circuit and said driver.

9. A LED power supply in accordance with claim 8, comprising:

a second filter circuit disposed between said second rectifier circuit and said output power terminals.

10. A LED power supply in accordance with claim 1, comprising:

a plurality of terminals carried by said third multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

11. A LED power supply in accordance with claim 10, comprising:

a first filter circuit disposed between said first rectifier circuit and said driver.

12. A LED power supply in accordance with claim 11, comprising:

a second filter circuit disposed between said second rectifier circuit and said output power terminals.

13. A LED power supply in accordance with claim 1, comprising:

a first insulating layer disposed between said first multilayer printed circuit board and said first core;

a second insulating layer disposed between said first multilayer printed circuit board and said third multilayer printed circuit board;

a third insulating layer disposed between said second multilayer printed circuit board and said second core; and a fourth insulating layer disposed between said second multilayer printed circuit board and said third multilayer printed circuit board.

14. A LED power supply in accordance with claim 13, wherein:

each of said first, second, third and fourth insulating layers comprises polyimide.

15. A LED power supply in accordance with claim 13, wherein:

said third multilayer printed circuit board comprises a fourth planar winding carried on another layer to provide a bias winding; and said bias winding is coupled to said driver circuit.

16. A LED power supply in accordance with claim 15, comprising:

a plurality of terminals carried by said third multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

17. A LED power supply in accordance with claim 16, comprising:

a first filter circuit disposed between said first rectifier circuit and said driver.

18. A LED power supply in accordance with claim 17, comprising:

a second filter circuit disposed between said second rectifier circuit and said output power terminals.

19. A LED power supply in accordance with claim 13, comprising:

a plurality of terminals carried by said third multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

20. A LED power supply in accordance with claim 19, comprising:

a plurality of terminals carried by said third multilayer printed circuit board;

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

21. A LED power supply in accordance with claim 20, comprising:

a first filter circuit disposed between said first rectifier circuit and said driver.

22. A LED power supply in accordance with claim 21, comprising:

a second filter circuit disposed between said second rectifier circuit and said output power terminals.

23. A LED power supply in accordance with claim 13, comprising:

a plurality of terminals carried by said third multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

24. A LED power supply in accordance with claim 23, comprising:

a first filter circuit disposed between said first rectifier circuit and said driver.

25. A LED power supply in accordance with claim 24, comprising:

a second filter circuit disposed between said second rectifier circuit and said output power terminals.

26. A light emitting diode (LED) power supply for providing current to a plurality of LEDs, comprising:

a transformer first primary portion comprising a plurality of serially connected planar first primary windings;

a transformer second primary portion comprising a plurality of serially connected planar second primary windings;

a transformer secondary comprising a planar secondary winding;

a multilayer printed circuit board comprising:

at least one layer having said planar secondary winding formed thereon;

a multilayer first printed circuit board carried on said multilayer printed circuit board, each of said planar first primary windings carried on a corresponding separate one layer of said multilayer first printed circuit boards;

a multilayer second printed circuit board carried on said multilayer printed circuit board, each of said planar second primary windings carried on a corresponding separate one layer of said multilayer second printed circuit boards;

said multilayer first printed circuit board, said second multilayer second printed circuit board, and said planar secondary winding in axial alignment with each other to provide electromagnetic coupling there between;

a transformer core carried by said multilayer printed circuit board extending over said first primary portion and said second primary portion and extending through said multilayer printed circuit board;

a first rectifier circuit carried on said multilayer printed circuit board for rectifying alternating current (ac) from a power source;

a driver circuit carried on said multilayer printed circuit board and disposed between said first rectifier circuit and said first and second primary portions; and a second rectifier circuit carried on said multilayer printed circuit board and coupled to said secondary and coupled to output power terminals to provide direct current for powering said plurality of LEDs.

27. A LED power supply in accordance with claim 26, wherein:

said multilayer printed circuit board comprises a fourth planar winding carried on another layer to provide a bias winding; and said bias winding is coupled to said driver circuit.

28. A LED power supply in accordance with claim 27, comprising:

a plurality of terminals carried by said multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

29. A LED power supply in accordance with claim 28, comprising:

a first filter circuit disposed between said first rectifier circuit and said driver.

30. A LED power supply in accordance with claim 29, comprising:

a second filter circuit disposed between said second rectifier circuit and said output power terminals.

31. A LED power supply in accordance with claim 26, comprising:

a plurality of terminals carried by said multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

32. A LED power supply in accordance with claim 31, comprising:

a plurality of terminals carried by said third multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

33. A LED power supply in accordance with claim 32, comprising:

a first filter circuit disposed between said first rectifier circuit and said driver.

34. A LED power supply in accordance with claim 33, comprising:

a second filter circuit disposed between said second rectifier circuit and said output power terminals.

35. A LED power supply in accordance with claim 26, comprising:

a plurality of terminals carried by said multilayer printed circuit board;

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

36. A LED power supply in accordance with claim 35, comprising:

a first filter circuit disposed between said first rectifier circuit and said driver.

37. A LED power supply in accordance with claim 36, comprising:

a second filter circuit disposed between said second rectifier circuit and said output power terminals.

38. A LED power supply in accordance with claim 26, comprising a first insulating layer disposed between said first multilayer printed circuit board and said first core;

a second insulating layer disposed between said first multilayer printed circuit board and said multilayer printed circuit board;

a third insulating layer disposed between said second multilayer printed circuit board and said second core; and a fourth insulating layer disposed between said second multilayer printed circuit board and said multilayer printed circuit board.

39. A LED power supply in accordance with claim 38, wherein:

each of said first, second, third and fourth insulating layers comprises polyimide.

40. A LED power supply in accordance with claim 38, wherein:

said multilayer printed circuit board comprises a fourth planar winding carried on another layer to provide a bias winding; and said bias winding is coupled to said driver circuit.

41. A LED power supply in accordance with claim 40, comprising:

a plurality of terminals carried by said multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

42. A LED power supply in accordance with claim 41, comprising:

a first filter circuit disposed between said first rectifier circuit and said driver.

43. A LED power supply in accordance with claim 42, comprising:

a second filter circuit disposed between said second rectifier circuit and said output power terminals.

44. A LED power supply in accordance with claim 38, comprising:

a plurality of terminals carried by said multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

45. A LED power supply in accordance with claim 44, comprising:

a plurality of terminals carried by said multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

46. A LED power supply in accordance with claim 45, comprising:

a first filter circuit disposed between said first rectifier circuit and said driver.

47. A LED power supply in accordance with claim 46, comprising:

a second filter circuit disposed between said second rectifier circuit and said output power terminals.

48. A LED power supply in accordance with claim 38, comprising:

a plurality of terminals carried by said multilayer printed circuit board:

said first primary portion connected to first terminals of said plurality of terminals;

said second primary portion connected to second terminals of said plurality of terminals;

said first terminals and said second terminals being selectively connectable to connect said first primary portion in parallel with or in series with said second primary portion.

49. A LED power supply in accordance with claim 48, comprising:

a first filter circuit disposed between said first rectifier circuit and said driver.

50. A LED power supply in accordance with claim 49, comprising:

a second filter circuit disposed between said second rectifier circuit and said output power terminals.

51. A light emitting diode (LED) power supply for providing current to a plurality of LEDs, comprising:

a transformer first primary portion;

a transformer second primary portion;

a transformer secondary portion;

a multilayer printed circuit board comprising:

at least one layer having a planar secondary winding formed thereon, said transformer secondary portion comprising said planar secondary winding;

a plurality of multilayer first printed circuit boards carried on said multilayer printed circuit board, said transformer first primary portion comprising a plurality of serially connected planar first primary windings, each of said planar first primary windings carried on a corresponding separate one layer of said plurality of multilayer first printed circuit boards;

a plurality of multilayer second printed circuit boards carried on said multilayer printed circuit board, said transformer second primary portion comprising a plurality of serially connected planar second primary windings, each of said planar second primary windings carried on a corresponding separate one layer of said plurality of multilayer second printed circuit boards;

said plurality of multilayer first printed circuit boards, said plurality of multilayer second printed circuit boards, and said planar secondary winding in alignment with each other to provide electromagnetic coupling there between;

a transformer core carried by said multilayer printed circuit board extending over said first primary portion and said second primary portion and extending through said multilayer printed circuit board;

a first rectifier circuit carried on said third multilayer printed circuit board for rectifying alternating current (ac) from a power source;

a driver circuit carried on said third multilayer printed circuit board and disposed between said first rectifier circuit and said first and second primary portions; and a second rectifier circuit carried on said third multilayer printed circuit board and coupled to said secondary and coupled to output power terminals to provide direct current for powering said plurality of LEDs.

52. A LED power supply in accordance with claim 51, comprising:

a transformer bias winding;

said multilayer printed circuit board comprises another planar winding carried on another layer, said transformer bias winding comprise said another planar winding; and said bias winding is coupled to said driver circuit.

53. A LED power supply in accordance with claim 52, comprising:

a plurality of terminals carried by said multilayer printed circuit board;

said transformer first primary portion connected to first terminals of said plurality of terminals;

said transformer second primary portion connected to second terminals of said plurality of terminals;

said first terminals and said second terminals being selectively connectable to connect said first primary portion in parallel with or in series with said second primary portion.

* * * * *